US005514635A

United States Patent [19]

Filo

[11] Patent Number: 5,514,635

[45] Date of Patent: May 7, 1996

[54] THERMAL WRITING SURFACE AND METHOD FOR MAKING THE SAME

[75] Inventor: Andrew S. Filo, Cupertino, Calif.

[73] Assignee: Optum Corporation, Cupertino, Calif.

[21] Appl. No.: 174,304

[22] Filed: Dec. 29, 1993

[51] Int. Cl.[6] ..... B41M 5/40

[52] U.S. Cl. ..... 503/200; 427/152; 503/201

[58] Field of Search ..... 503/200, 226, 503/201; 427/152

[56] References Cited

U.S. PATENT DOCUMENTS

| | | | |
|---|---|---|---|
| 1,592,148 | 7/1926 | Munn . | |
| 1,656,690 | 1/1928 | Blackburn . | |
| 3,167,444 | 1/1965 | Baumann et al. . | |
| 3,167,445 | 1/1965 | Baumann et al. . | |
| 3,561,269 | 2/1971 | Seitz | 73/356 |
| 3,802,945 | 4/1974 | James | 161/5 |
| 3,969,606 | 7/1976 | Veach | 219/237 |
| 4,028,118 | 6/1977 | Nakasuji et al. | 106/21 |
| 4,142,782 | 3/1979 | O'Brian | 350/354 |
| 4,151,748 | 5/1979 | Baum | 738/356 |
| 4,176,273 | 11/1979 | Fujie et al. | 219/220 |
| 4,425,161 | 1/1984 | Shibahashi et al. | 106/21 |
| 4,445,787 | 5/1984 | Parker | 374/141 |
| 4,554,565 | 11/1985 | Kito et al. | 346/201 |
| 4,703,335 | 10/1987 | Matsushita et al. | 503/204 |
| 4,717,710 | 1/1988 | Shimizu et al. | 503/213 |
| 4,720,301 | 1/1988 | Kito et al. | 106/21 |
| 4,725,462 | 2/1988 | Kimura | 428/29 |
| 4,732,810 | 3/1988 | Kito et al. | 428/402 |
| 4,818,215 | 4/1989 | Taga | 431/426 |
| 4,820,683 | 4/1989 | Vervacke et al. | 503/210 |
| 4,826,550 | 5/1989 | Shimuzi et al. | 156/166 |
| 4,834,500 | 5/1989 | Hilsum et al. | 350/331 |
| 4,853,361 | 8/1989 | Satake et al. | 503/201 |
| 4,853,362 | 8/1989 | Satake et al. | 503/209 |
| 4,855,277 | 8/1989 | Walter | 503/204 |
| 4,855,279 | 8/1989 | Ikeda et al. | 503/209 |
| 4,888,219 | 12/1989 | Barnes | 428/1 |
| 4,895,827 | 1/1990 | Vervacke et al. | 503/210 |
| 4,917,643 | 4/1990 | Hippely et al. | 446/14 |
| 4,917,948 | 4/1990 | Hotta | 428/335 |
| 4,920,991 | 5/1990 | Shibahashi | 132/73 |
| 4,977,030 | 12/1990 | Hotta et al. | 428/447 |
| 5,011,445 | 4/1991 | Nakasuji et al. | 446/14 |
| 5,037,696 | 8/1991 | Miyake et al. | 428/336 |
| 5,049,428 | 9/1991 | Kanno et al. | 428/447 |
| 5,073,696 | 12/1991 | Patillo et al. | 219/233 |

(List continued on next page.)

FOREIGN PATENT DOCUMENTS

| | | | |
|---|---|---|---|
| 2063973 | 3/1992 | Canada | 346/76 PH |
| 0506452A1 | 3/1992 | European Pat. Off. | 503/201 |
| 3-092934 | 3/1991 | Japan | 503/201 |
| 3-091133 | 3/1991 | Japan | 503/201 |
| 3-092933 | 3/1991 | Japan | 503/201 |
| 3-128439 | 4/1991 | Japan | 503/201 |
| 3-233917 | 8/1991 | Japan | 503/201 |
| 3-270370 | 9/1991 | Japan | 503/201 |
| 3-305410 | 10/1991 | Japan | 503/201 |
| 4-329993 | 11/1992 | Japan | 503/201 |
| 5-50754 | 3/1993 | Japan | 503/201 |
| 5-77551 | 3/1993 | Japan | 503/201 |

OTHER PUBLICATIONS

"Chromicolor", Product Catalogue for Matsui Shikiso Chemical Co., Ltd., 16 pages.

Instruction for Nickelodeon Color Writer™ Drawing Screen, copyright 1992, two pages.

*Primary Examiner*—B. Hamilton Hess

*Attorney, Agent, or Firm*—Feix & Feix

[57] ABSTRACT

A thermal writing device which changes color in response to induced temperature changes and a method for making such a device is disclosed. The thermal writing device includes a flexible substrate with low thermal mass for rapidly assimilating temperatures. Thermochromic inks which change color when subjected to temperature changes are printed upon or incorporated within this flexible substrate. The flexible substrate is disposed upon a support material having low thermal mass and poor heat conductance to facilitate rapid color transitions by the thermochromic inks with minimal expenditures of energy.

14 Claims, 10 Drawing Sheets

U.S. PATENT DOCUMENTS

| | | | |
|---|---|---|---|
| 5,079,049 | 1/1992 | Kito et al. | 428/24 |
| 5,085,607 | 2/1992 | Shibahashi et al. | 446/14 |
| 5,087,601 | 2/1992 | Hotta et al. | 503/200 |
| 5,152,611 | 10/1992 | Pieper et al. | 374/160 |
| 5,158,924 | 10/1992 | Konagaya et al. | 503/201 |
| 5,158,926 | 10/1992 | Hotta et al. | 503/217 |
| 5,219,625 | 6/1993 | Matsunami et al. | 428/30 |
| 5,219,820 | 6/1993 | Morohoshi et al. | 503/204 |
| 5,254,382 | 10/1993 | Ueno et al. | 428/64 |
| 5,258,350 | 11/1993 | Inoue et al. | 503/204 |
| 5,258,353 | 11/1993 | MacDonald et al. | 503/227 |
| 5,260,254 | 11/1993 | Hotta et al. | 503/217 |
| 5,316,513 | 5/1994 | Nakagawa et al. | 446/14 |

THERMAL WRITING SURFACE AND METHOD FOR MAKING THE SAME

FIELD OF INVENTION

The invention relates to writing surfaces and more particularly to erasable writing surfaces which can be marked and erased by inducing temperature changes in the surface.

BACKGROUND OF THE INVENTION

Reusable writing and drawing surfaces have many applications ranging from educational and business uses to applications with purely entertainment value. The appeal of these surfaces generally lies in their ability to be easily cleaned and re-used without necessitating the disposal of the entire marked surface. In other words, during normal use, the writing instruments used to mark the surface become depleted and require replacement while the writing surface itself remains intact.

It would be desirable to produce a surface that can be used and re-used without depleting either the surface or the writing utensils. However, traditional surfaces have been unable to achieve this goal. Instead, traditional re-usable surfaces employ writing utensils which transfer a non-permanent marking element such as ink or chalk to the surface. When the marking element is depleted, the writing utensil must be replaced or recharged in some fashion before further drawing can take place.

OBJECTS OF THE INVENTION

It is therefore a general object of the present invention to provide a reusable writing or drawing surface which can be marked similarly to traditional writing surfaces without depleting the marking instrument. It is a related object of the invention to provide a reusable drawing surface which can be marked without using ink, chalk or other transfer elements.

It is another object to provide a reusable drawing surface which can be marked and erased by inducing temperature changes in the surface. It is a related object to provide a thermally sensitive drawing surface which emulates the look and feel of traditional writing surfaces. It is still another object to provide a reusable drawing surface which changes color in response to temperature changes but which maintains its color state for extended periods of time at normal room temperatures.

SUMMARY OF THE INVENTION

The present invention accomplishes these objectives by providing a thermal writing surface which changes colors in response to temperature changes. The thermal writing surface has a unique multi-layer structure which enables the device to quickly assimilate temperatures induced by a user to achieve rapid color changes and to quickly return to ambient temperature without reversing the user induced color change. More specifically, the drawing surface includes a flexible substrate which has low thermal mass for quickly assimilating temperatures. This flexible substrate is printed with at least one thermochromic ink which changes color in response to temperature changes. For example, in one color state an ink might be blue, but when subjected to a sufficiently high temperature the ink might become red. By cooling the ink by a sufficient amount, the ink can be transitioned back from the red state to its original blue state.

In accordance with the invention, the thermal writing surface is provided with a second layer comprising a fibrous support material disposed adjacent to the flexible substrate. The fibrous support material is thermally neutral in that it has both low thermal mass and low heat conductance. Thus, it will quickly assimilate temperatures applied to the flexible substrate in small sections but will not transfer large amounts of thermal energy to or from the substrate. Further, the fibrous support material is a poor insulator. Thus, after the heat source is removed from the surface, the fibrous support material, and the adjacently disposed flexible substrate printed with thermochromic inks, will quickly return to the ambient temperature.

This combination of a flexible substrate imprinted with thermochromic inks and a fibrous support material results in a drawing surface which can be quickly and easily marked. Consequently, the drawing surface approximates the look, feel and function of a traditional writing surface without employing a traditional transfer medium such as chalk or ink.

These and other features and advantages of the invention will be more readily apparent upon reading the following description of the preferred embodiment of the invention and upon reference to the accompanying drawings.

DESCRIPTION OF THE PREFERRED EMBODIMENT

Figure 1:
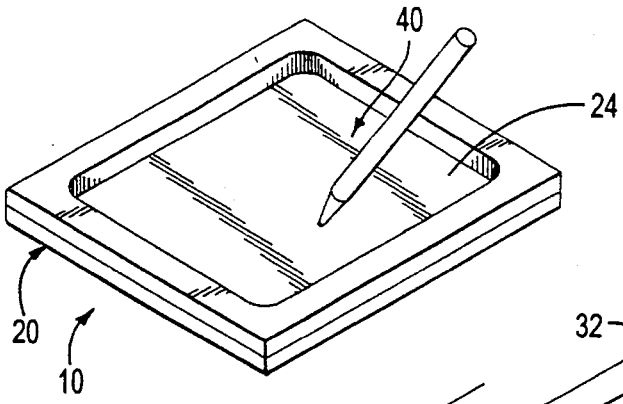
FIG. 1 is a left front perspective view of a drawing device including a drawing surface constructed in accordance with the teachings of the invention.

A thermal writing device 10 including a frame 20 and a writing surface 40 constructed in accordance with the teachings of the invention is illustrated in FIG. 1. The frame 20 is merely a vehicle for facilitating the use of the inventive drawing surface. Thus, it will be appreciated that the size and shape of the frame 20 are shown for explanatory purposes only. Indeed, although the frame 20 will always expose at least a portion of the drawing surface 40 for marking and erasing, it can be constructed in virtually any shape or size which is conducive to a particular application. For example, whether the thermal writing device 10 is to be used as a large wall mounted surface similar to a chalk board, as a large surface suitable for table top use by many individuals simultaneously, or as a small notepad-like device, the dimensions and construction of the frame 20 can be modified to suit the application without departing from the invention.

The presently preferred embodiment of the thermal writing device 10 is approximately 8½×11 inches in width and length, respectively. Thus, the mounting frame 20 which facilitates marking and erasing the writing surface 40 is sized accordingly. Preferably, the mounting frame 20 is constructed from lightweight molded plastic.

Figure 2:
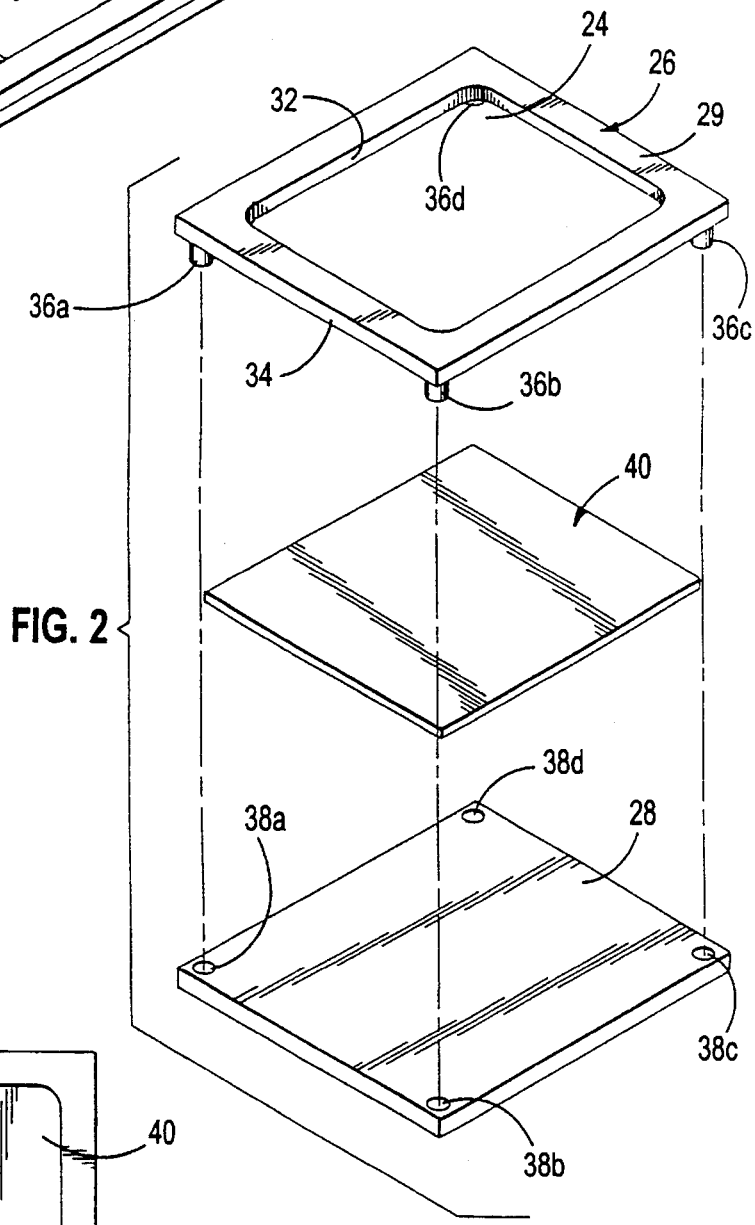
FIG. 2 is an exploded view of the drawing device.

As best seen in FIG. 2, the mounting frame 20 includes two interlocking pieces, an upper frame 26 and a support frame 28 which combine to secure the drawing surface 40 in a fixed position during use. The upper frame 26 is designed to perform the securing function and to facilitate marking the drawing surface 40. To this end, the upper frame 26 is provided with an upper surface 29 having an open area 24 which exposes the drawing surface 40. Thus, as illustrated in FIG. 1, the upper frame 26 permits easy access to the drawing surface 40. In addition, the inner rim 32 of the upper surface 29 which surrounds the open area 24 extends downward such that, when assembled, the inner rim 32 compresses the drawing surface 40 against the support frame 28 thereby retaining the drawing surface 40 in a fixed position. The outer rim 34 of the upper frame 26 also extends downward to abut the support frame 28 in the assembled position and gives the device a pleasing, sealed appearance.

In order to fixedly attach the upper frame 26 to the support frame 28, the upper frame 26 is provided with pegs 36*a–d* on the lower surface of its corners. Similarly, the support frame 28, which is preferably made of plastic, is provided with openings 38*a–d* for receiving the corresponding pegs 36*a–d*. The interaction of the pegs 36*a–d* of the upper frame 26 and the openings 38*a–d* of the support frame 28 serves to lock the two halves of the mounting frame 20 into a unitary structure.

As previously mentioned, the combination of the two frame halves 26, 28 can be used to hold the writing surface 40 in a fixed position. However, it will be appreciated that other means of securing the drawing surface 40 to the support block 28 might also be appropriate. For example, an adhesive such as a pressure sensitive adhesive could be applied to the support frame 28 and the bottom of the drawing surface 40 to hold the surface 40 in place during use and assembly. Similarly, it will be appreciated that other frame constructions and configurations could also be employed with the inventive drawing surface.

Figure 3:
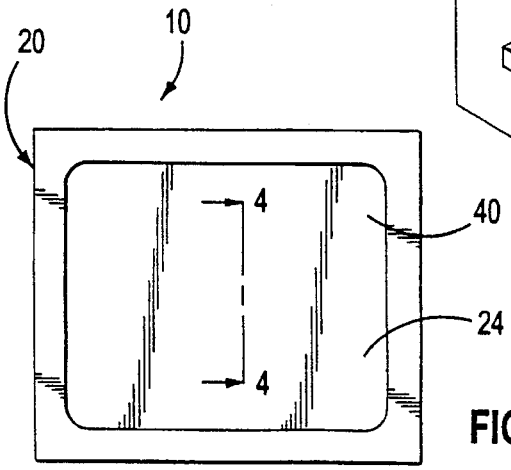
FIG. 3 is a top plan view of the drawing device illustrating the drawing surface in a white color state.

As illustrated in FIG. 3, the thermal writing device 10 provides a large drawing surface 40 for a user to mark. This drawing surface 40 is provided with a layer of thermochromic ink or inks which change color in response to temperature changes. Thermochromic inks are commercially available products whose properties are known in the art. Known thermochromic ink compositions are disclosed, for example, in U.S. Pat. No. 4,717,710. Therefore, it is unnecessary to provide a detailed description of their operation in this application. It is sufficient to say that thermochromic inks come in several types. They can be chosen to change between color states, i.e. from one color to another color, such as red to yellow, or from colorless to a color, such as clear to red, and vice versa.

Further, the inks can be chosen such that they exhibit hysteresis properties. For example, an ink might be provided which, while initially colorless, will turn red upon cooling to a temperature x. Then, to change the ink back to colorless the user would need to raise its temperature to a level y, which is above the temperature x noted above. Any temperature less than y will not change the color of the ink.

This hysteresis property is advantageous in the present invention because inks can be selected which do not change temperature in response to room temperature changes but only when subjected to temperatures intentionally in excess of the transition temperature. Furthermore, inks can be chosen which change color when heated to a level above the average room temperature of most buildings but below the average body temperature of a human, which is approximately 98.6° F. (37° C.) so that placing a human hand upon the surface will change the color of the ink. Thus, a user can use his or her hand to draw upon or erase the drawing surface 40.

Ambient temperatures in most heated and air conditioned buildings generally range between 69° F. (20.6° C.) and 75° F. (23.9° C.). Thus, if for example the ambient temperature in a given building is 73° F. (22.8° C.), and the lower transition temperature (x in the example given above) is 50° F. (10° C.), and the higher transition temperature (y) is 87° F. (30.5° C.), the normal ambient temperature fluctuations will not cause color transitions in the writing surface 40.

As previously mentioned, thermochromic inks are commercially available products. At present, the thermochromic inks sold under the trademark "Chromicolor" by Matsui Shikiso Chemical Co., Ltd., a Japanese company with an office at 302 W. Grand Avenue, Suite 4, El Segundo, Calif. 90245 U.S.A. are preferred. Preferably the thermochromic inks sold under the label "History Type 2.5" are used.

Figure 4:
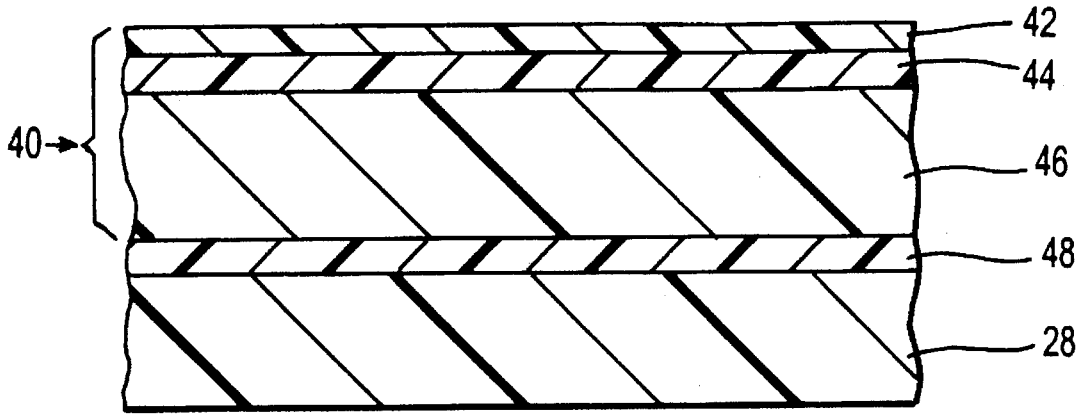
FIG. 4 is an enlarged, cross-sectional view of a drawing surface taken along lines 4—4 of FIG. 3.

As noted above, the drawing surface 40 could be impinged between the two halves of the frame 20 such that it floats above the support frame 28. However, it should also be noted that in the preferred embodiment the drawing surface 40 is affixed to the support frame 28 by an adhesive 48 as shown in FIG. 4. Preferably, a sheet mounted adhesive such as the commercially available #3502 Heat N Bond which is manufactured by Thermo Web Inc., Wheeling, Ill. is used in this role although other adhesives might likewise be appropriate.

Figure 5A:
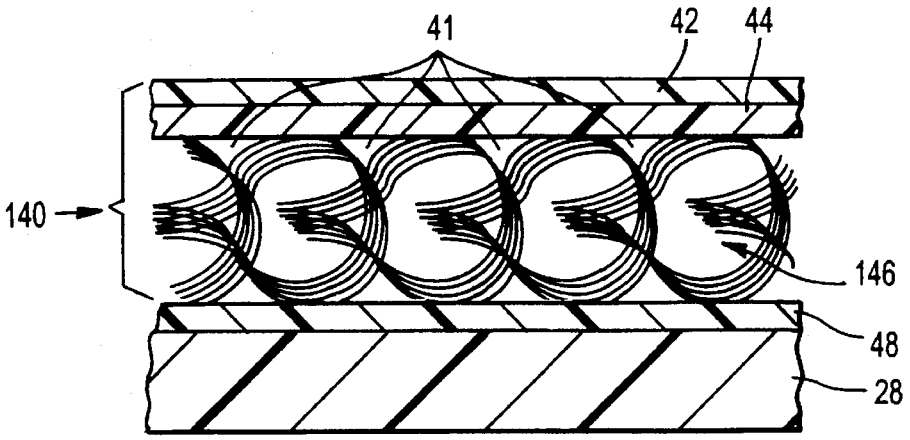
FIG. 5A is a view similar to FIG. 4 but illustrating a drawing surface employing a fibrous support layer constructed of chain knitted fibers.
Figure 5B:
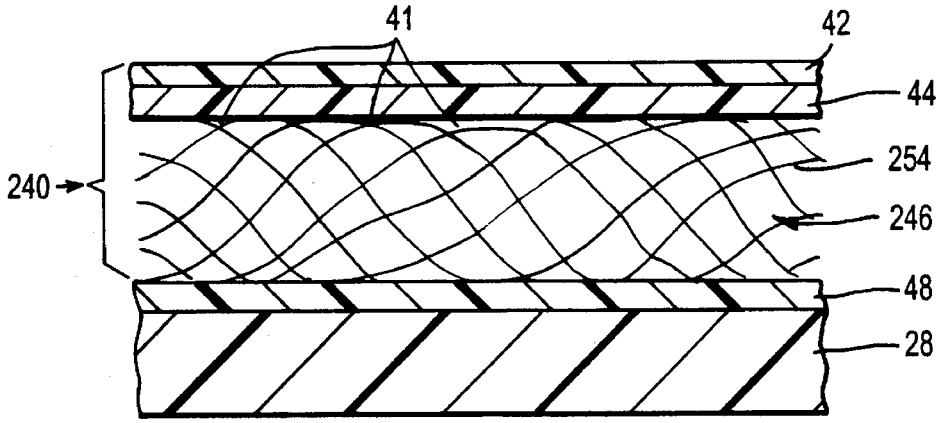
FIG. 5B is a view similar to FIG. 5A but illustrating an alternative fibrous support layer constructed from spun fibers.
Figure 5C:
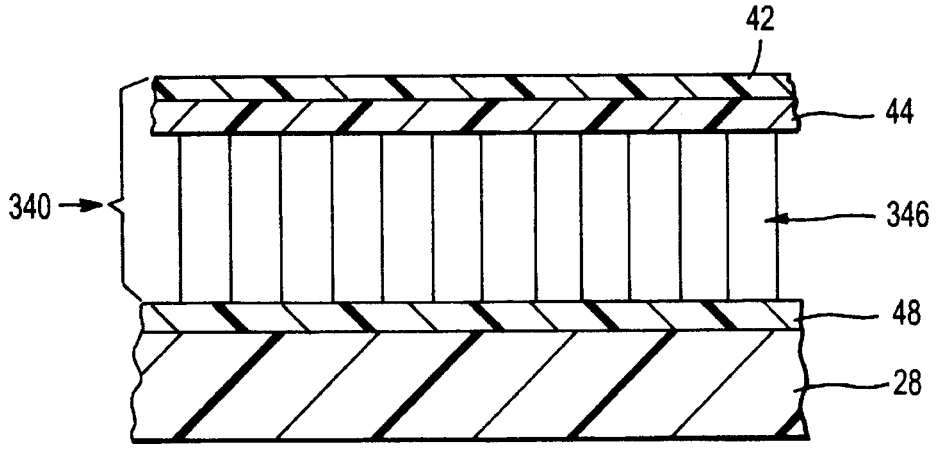
FIG. 5C is a view similar to FIG. 5B but illustrating a second alternative fibrous support layer constructed from vertically oriented fibers.

Referring the FIGS. 4–5C, the drawing surface 40 is constructed with a unique multi-layer structure which enables the thermochromic inks to rapidly transition between color states to simulate the look and effect of traditional writing surfaces. To this end, the surface 40 comprises a layer of thermochromic inks 42, a flexible substrate 44, and a fibrous support material 46. As mentioned above, this surface 40 can be affixed to the support frame 28 by an adhesive 48.

As illustrated in FIG. 4, the thermochromic inks 42 are preferably printed upon a flexible substrate 44 and, thus, the inks and the substrate will have approximately the same temperature. Consequently, in order to heat the inks 42 sufficiently to change their color state, the substrate 44 must likewise be heated. Similarly, in order to transition the inks 42 by lowering their temperature, the substrate 44 must be cooled. It will thus be appreciated that the rate at which the substrate 44 changes temperature is a major factor in determining the time required to transition the inks 42 from one color state to another state. If the temperature of the substrate 44 can be quickly changed (i.e. the substrate has low thermal mass) the color state of the inks 42 will be similarly quick to change. If, on the other hand, the substrate 44 resists temperature changes (i.e. it has high thermal mass), the inks 42 will be slower to transition. Since it is desirable for the inks 42 to transition as quickly as possible to achieve fast drawing speed, the substrate 44 is preferably constructed from a material having low thermal mass to promote rapid color changes at low energy levels.

Figure 7:
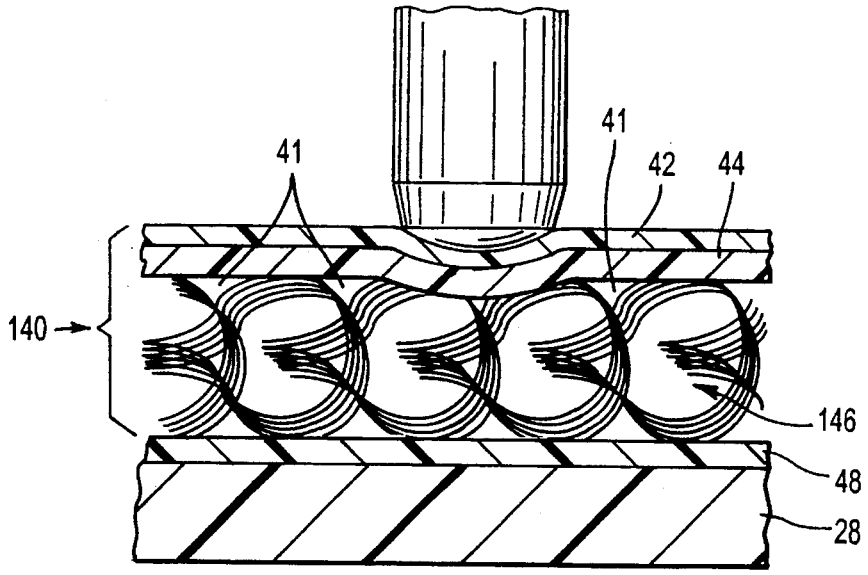
FIG. 7 is an enlarged cross-sectional view similar to FIG. 5A but illustrating the deformation of the surface when subjected to the pressure of a writing instrument.

Moreover, to properly simulate a traditional writing surface, the flexible substrate 44 is sufficiently resilient to permit the user to write naturally at high speeds and low stylus pressure without fear of tearing or scratching the surface 40. The resilience of the very thin, compliant substrate 44 enables the surface 40 to temporarily deform when subjected to the pressure of a stylus or hand. As illustrated in FIG. 7, this deformation will actually cause the surface 40 to conform to the stylus, thus, insuring sufficient contact between the tip of a stylus and the ink bearing substrate 44 and promoting rapid color transitions.

In addition, the substrate 44 is constructed to exhibit no mechanical memory and to have high elasticity at low actuation forces. Thus, the substrate 44 will temporarily deform when subjected to pressure and thus, achieves a smooth writing effect. Further, the compliant substrate 44 quickly returns to its undeformed position without mechanical memory effects insuring the surface remains smooth with repeated use.

Preferably the flexible substrate 44 comprises polyurethane which is commercially available from Union Carbide of New Jersey. A substrate constructed from polyurethane can be easily heated or cooled and its resilience makes scratching difficult. The thickness of the substrate 44 is preferably 1/128th inches. However, it will be appreciated by those skilled in the art that other resilient materials with low thermal mass might also be an appropriate choice for a substrate. Similarly, the thickness of the substrate 44 can be varied without departing from the spirit of the invention. In addition, although the thermochromic inks 42 have been described as being printed upon the substrate 44, the inks 42 could also be incorporated within the substrate without departing from the invention. In this instance, it will be appreciated that the inks 42 and the substrate 44 would be included in a single layer.

Due to the low thermal mass of the substrate 44, heat will be readily transferred to and from any object which the substrate 44 intimately abuts. Thus, if the substrate 44 is placed upon a surface that readily absorbs heat, it will be difficult to heat the thermochromic inks 42 sufficiently to induce a color change because the abutting surface will drain the applied heat away from the substrate 44. The inverse problem will arise when attempting to cool the substrate 44. Heat will be absorbed from the abutting surface into the substrate 44 in frustration of the cooling process.

In accordance with an important aspect of the invention, the drawing surface 40 is provided with a fibrous support material 46 which both overcomes the problems associated with heat transfers from materials abutting the flexible substrate 44 and supplements the advantages associated with the resilience of the substrate 44. The fibrous support material 46 is thermally neutral in that it has both low thermal mass and low thermal conductance. This thermal neutrality insures that while the material 46 does not readily transmit heat throughout its volume (poor thermal conductance), it can nonetheless be easily heated or cooled in small sections (low thermal mass or poor thermal insulation). This combination of poor temperature conductance and low thermal mass insures that the temperature of small portions of the fibrous support material can be quickly changed with minimal expenditure of energy. Thus, the abutting substrate 44 and inks 42 can likewise be easily heated and cooled.

The thermal properties of the support material 46 also insure that induced temperature changes will not bleed laterally throughout the drawing surface 40 causing wide spread color transitions in the thermochromic inks. Since the support material 46 is a poor conductor of heat, heat applied to one area of the material 46 will not be transmitted to other areas. Consequently, heat applied to one area of the drawing surface will only transition the inks in that area. It will not transition inks in other areas.

If the substrate 44 were mounted directly to another surface without the benefit of the fibrous support material 46, the color of the thermochromic inks 42 would only change under extreme temperatures. For example, if the substrate was merely mounted directly to the frame 28, any heat applied to the substrate 44 would also be absorbed into the frame. Under these circumstances, thermal energy in amounts potentially destructive to the ink 42 and substrate 44 would be needed to achieve a temperature sufficient to transition the inks 42 from one color state to another color state. Similarly, in order to transition the color states of the ink by cooling, a user would need to sufficiently cool the substrate 44 and the mounting frame 28 because a non-isolated substrate 44 would draw heat from the frame 28 thereby resisting the temperature change the user is attempting to achieve. Thus, the fibrous support material 46 thermally isolates the substrate 44 from abutting materials thereby enabling the drawing device 10 to efficiently take advantage of the low thermal mass of the substrate 44 to facilitate color transitions in the thermochromic inks 42.

In addition, the fibrous support material 46 contains a great deal of air. The material 46 is highly breathable and presents very little impedance to air flow and convection. This breathable nature makes the fibrous support material 46 a very poor insulator. As a result, when a temperature source is removed from an area of the drawing surface 40, the area of the fibrous material 46 juxtaposed with the heated (or cooled) area will quickly return to ambient temperature because the substantial volume of free air in the fibrous support material 46 quickly dissipates any residual temperatures in that area of the material 46. The rapid return to the ambient temperature by the fibrous support material 46 in turn promotes a rapid return to the ambient temperature by the flexible substrate 44. Because of this rapid return to the ambient temperature, the drawing surface can be marked and then quickly erased or vice versa.

The mechanical properties of the fibrous support material 46 also contribute to the drawing surface's close simulation of a traditional writing surface. As previously mentioned, the flexible substrate 44 is very thin and compliant. The fibrous support material 46 supplements the advantageous properties of the compliant substrate 44 by both providing a robust mechanical support for the thin substrate 44 and remaining sufficiently compliant to lower stylus pressure and reduce mechanical memory in the substrate 44. Thus, the combination of the flexible substrate 44 and the fibrous support material 46 results in a drawing surface whose mechanical properties closely simulate the properties of traditional smooth writing surfaces.

As previously mentioned, the fibrous support layer 46 includes a substantial volume of air. Although the substrate 44 is preferably heat fused to the fibrous material 46, the volume of air in the support layer 46 insures that air gaps 41 often exist between the substrate 44 and the support layer 146 as illustrated in FIG. 7. When a stylus is placed against the drawing surface 40, the substrate 44 will conform to the stylus tip and deform against the fibrous support layer 146. The deformation of the substrate 44 squeezes out any air gaps 41 between the two layers 44, 146. Since air is an insulator, the exclusion of air increases the energy transmitted between the layers by approximately ten times.

Figure 6A:
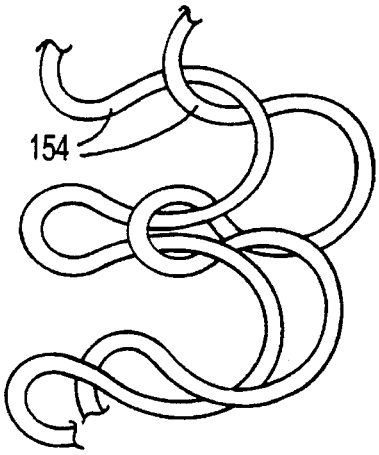
FIG. 6A is an enlarged, partial view of chain knitted fibers in the fibrous support layer.

In the preferred embodiment, the support material 46 comprises a chain knitted material 146 as illustrated in FIG. 5A. As best seen in FIG. 6A, this chain knitted material 146 comprises individual bundles of fiber 154 which are woven together to form a loose chain. Even more preferably, the individual bundles of fiber 154 comprise approximately 15 strands of cotton and 15 strands of polyester wrapped together—similar to a woven rope but on a much smaller scale. At present a chain knitted fabric comprising approximately four bundles of fiber chain knitted together is preferred. This commercially available product is sold under the product name "Cindy Interlock #9910" by Beachwood Fabrics in Hudson, Ohio and is approximately 0.025 inches thick.

In an alternative embodiment, the fibrous support material comprises spun polyester fiber material 246 as illustrated in FIG. 5B. This spun fiber material 246 comprises fibers 254 similar to those used in the preferred chain knitted approach but instead of being knitted, the fibers 254 are stacked in random fashion. Beachwood Fabrics in Hudson, Ohio sells a polyester interface under product number 56,806,001 comprising 100% polyester fibers stacked in random fashion which is preferred for this alternative embodiment.

Figure 6B:
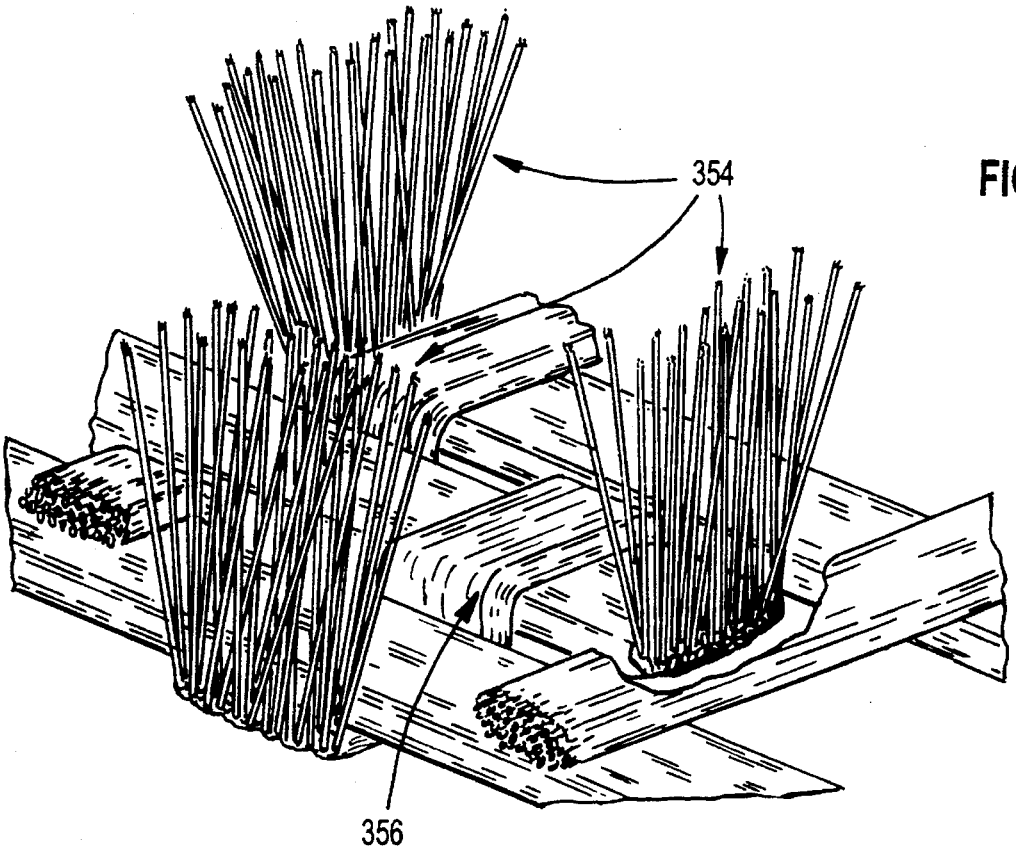
FIG. 6B is an enlarged, partial view of an alternative fibrous support layer constructed from vertically oriented fibers.
Figure 6C:
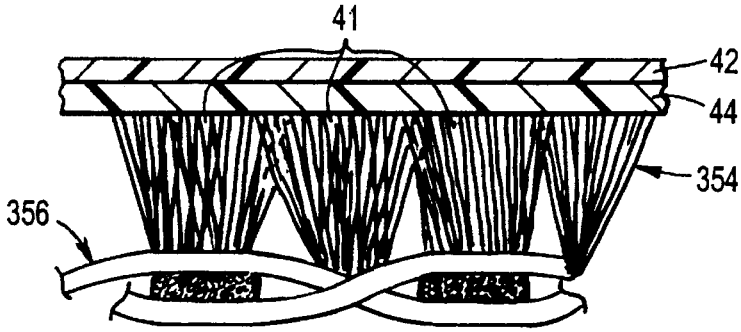
FIG. 6C is a cross-sectional view of the fibrous support layer of FIG. 6B interacting with a substrate.

A second alternative embodiment is illustrated in FIG. 5C. In that embodiment, the fibrous support layer comprises vertically oriented fibers 346. As best seen in FIGS. 6B and 6C, the vertically oriented fibers 346 comprise bundles 354 of individual fibers gathered into a basket weave matrix 356 which holds the bundles 354 in a vertical position. Beachwood Fabrics in Hudson, Ohio sells a fabric under the product name "Velvet #117" which is 25% Rayon and 75% Acetate which is presently preferred in this role.

As previously mentioned, the drawing surface 40 attempts to simulate a traditional writing surface such as paper. Specifically, the writing speed, writing force, and erasing speed of the surface 40 all attempt to approximate the speeds and writing forces of a traditional surface. Three tests were used to measure these elements of the surface: (1) a streak test; (2) a latent temperature test; and (3) a resilience and memory test.

These tests were performed on several different test specimens to determine the comparative effectiveness of surfaces having varied constructions. In each of these tests, the test specimens included a flexible substrate printed with thermochromic inks. However, each test specimen included a different support material having different characteristics than the other specimens. Since only the support materials were varied (i.e., the flexible substrate and thermochromic inks used in each specimen were substantially the same), the conducted tests were designed to determine the effect of using different support layers in a drawing surface. It should be emphasized that the same test materials were use in each of the three tests.

Figure 8A:
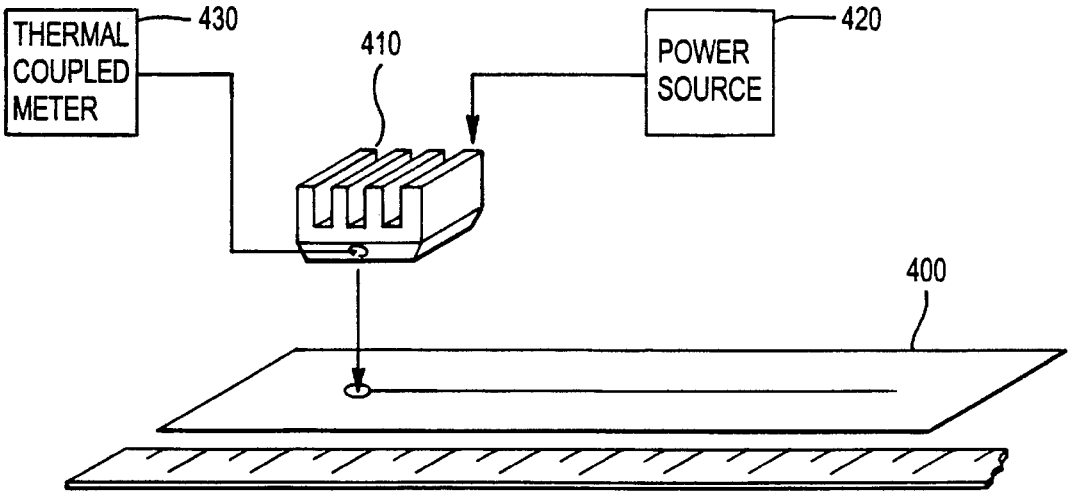
FIG. 8A is an illustration of a method for testing the writing speed of a drawing surface.

The streak test illustrated in FIG. 8A was used to measure the writing speed of various test surfaces 400. The test employs a peltier device 410 which, as is known in the art, is capable of becoming either hot or cold when supplied with an electrical current from a power source 420. During the test, the peltier device 410 was maintained at a constant 48° F. (8.9° C.) (as measured by a thermal coupled meter 430) and passed over the test specimen 400 such that it transitioned the inks from one color state to another. The speed of the peltier device 410 was varied with respect to each test specimen 400 until the fastest possible speed at which the inks of the specimen would permanently transition was determined. The peltier device 400 was then passed over the specimen at this maximum speed for a period of one second. The length of the streak "drawn" upon the test specimen 400 in one second was then measured to determine the maximum writing speed of the specimen 400.

Figure 8B:
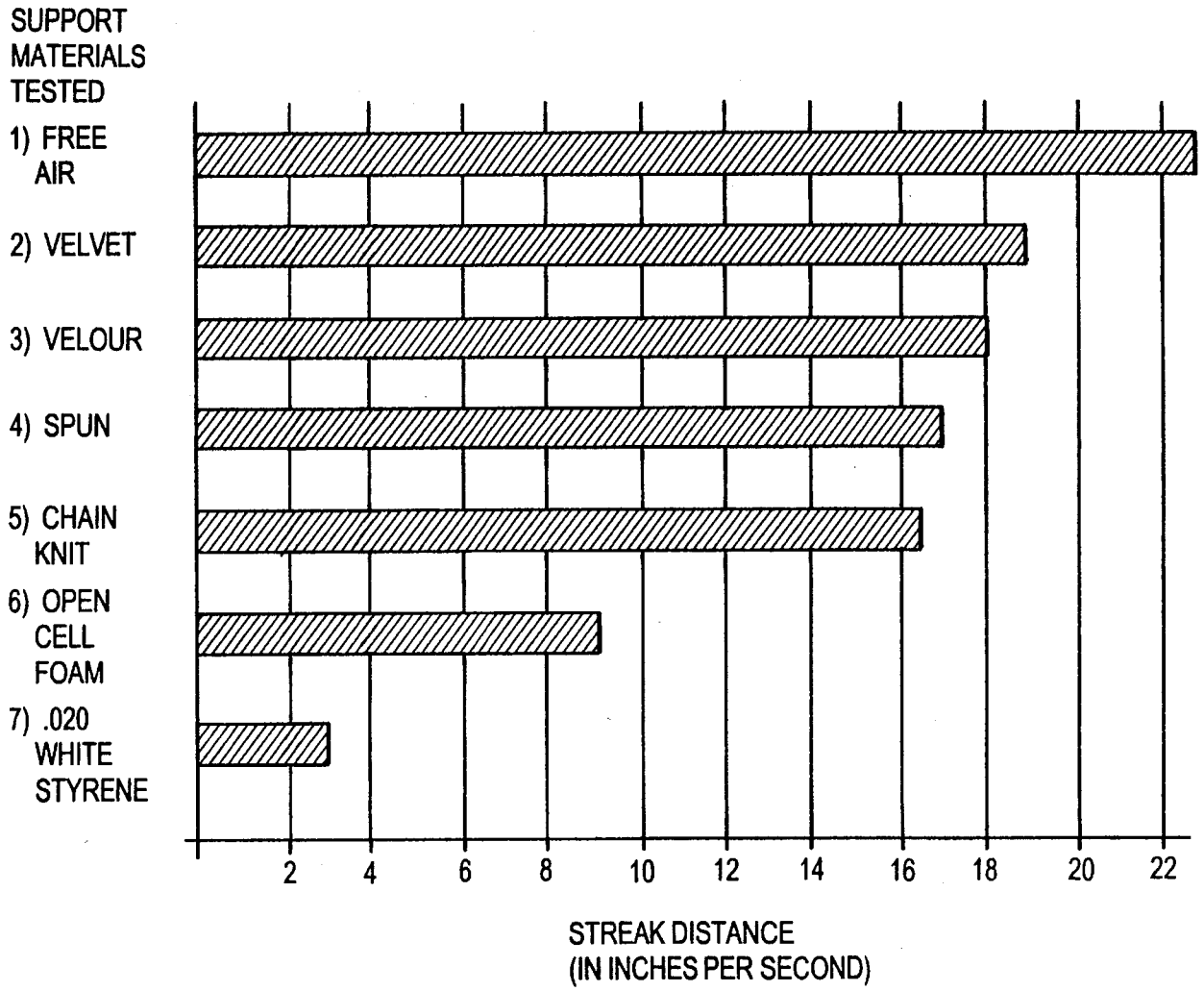
FIG. 8B is a chart illustrating the drawing speeds of various drawing surfaces constructed with various support layers as measured by the test of FIG. 8A.

A chart illustrating the maximum writing speed of the tested specimens is shown in FIG. 8B. As mentioned above, each test specimen employed substantially the same flexible substrate printed with substantially the same composition of thermochromic inks. However, each included a distinct support material. The tested support materials starting from the top of FIG. 8B included:

1) Free air (i.e., the substrate was suspended in free air);

2) A velvet fabric sold under the product name "Velvet #117" by Beachwood Fabrics of Hudson, Ohio;

3) A velour fabric sold under the product name Brushed Velour #101-C by Beachwood Fabrics of Hudson, Ohio;

4) A spun polyester fabric sold under product number 56,806,001 by Beachwood Fabrics of Hudson, Ohio;

5) A chain knit fabric sold under the product name "Cindy Interlock #9910" by Beachwood Fabrics of Hudson, Ohio;

6) An open cell foam sold as part of the Nickelodeon™ Color Writer™ Drawing Screen by Mattel, Inc. of El Segundo, Calif. 90245; and, 7) 0.020 White Styrene (i.e., the flexible substrate mounted directly to a plastic frame).

As illustrated in FIG. 8B, the fastest drawing speeds were achieved when the flexible substrate was suspended in free air without the use of a support layer (i.e., test material 1) and the slowest drawing speeds were achieved when the flexible substrate was mounted directly to a plastic frame (i.e. test material 7). The remainder of the test results illustrate the effect of affixing support layers of various construction to the substrate. For example, although they were followed closely by surfaces with spun fiber support layers, surfaces constructed with velour and velvet support layers (in other words, surfaces with vertically oriented fibers) achieved the second and third fastest drawing speeds, respectively.

The streak test was performed using: (1) a peltier device 410 sold under the designation "1.362 Peltier Cooler—Large Peltier Junction" by Alltronics—Sendose of 2300 Zanker Rd, San Jose, Calif. 95131; (2) a thermal coupled meter 430 sold under product number 1003 by Ricoh of London, England; and (3) a power supply 420 sold under the designation "DC Power Supply Model 3003" by Protek of Pusan, Korea.

Figure 9A:
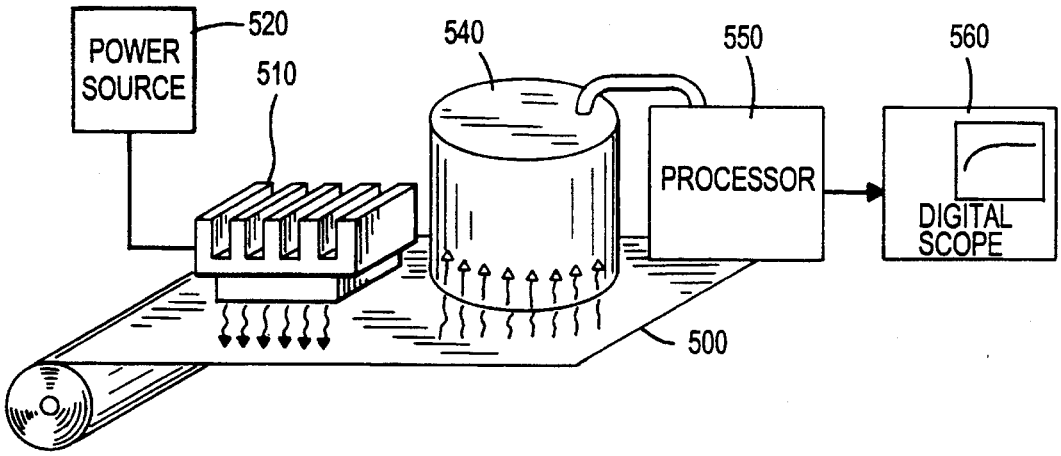
FIG. 9A is an illustration of a method for testing the rate of temperature change of a drawing surface.

The latent temperature test illustrated in FIG. 9A is designed to measure the effect of subjecting a test specimen 500 to low temperatures and its ability to return to ambient after the temperature source is removed. In this test a peltier device 510 is used to cool a test specimen 500 until its thermochromic inks transition to their second color state. The peltier device 510 is then removed and the cooled area of the specimen 500 is quickly positioned under an optical pyrometer 540 which, in conjunction with a processor 550 and a digital scope 560, records the rate at which the temperature of the specimen returns to ambient temperature. A quick return of the specimen to ambient temperature is necessary to enable rapid drawing and erasing of the same area. Thus, this property is important for emulating natural drawing and erasing speeds as well as the production of specific temperatures for multicolor tablet surfaces.

Figure 9B:
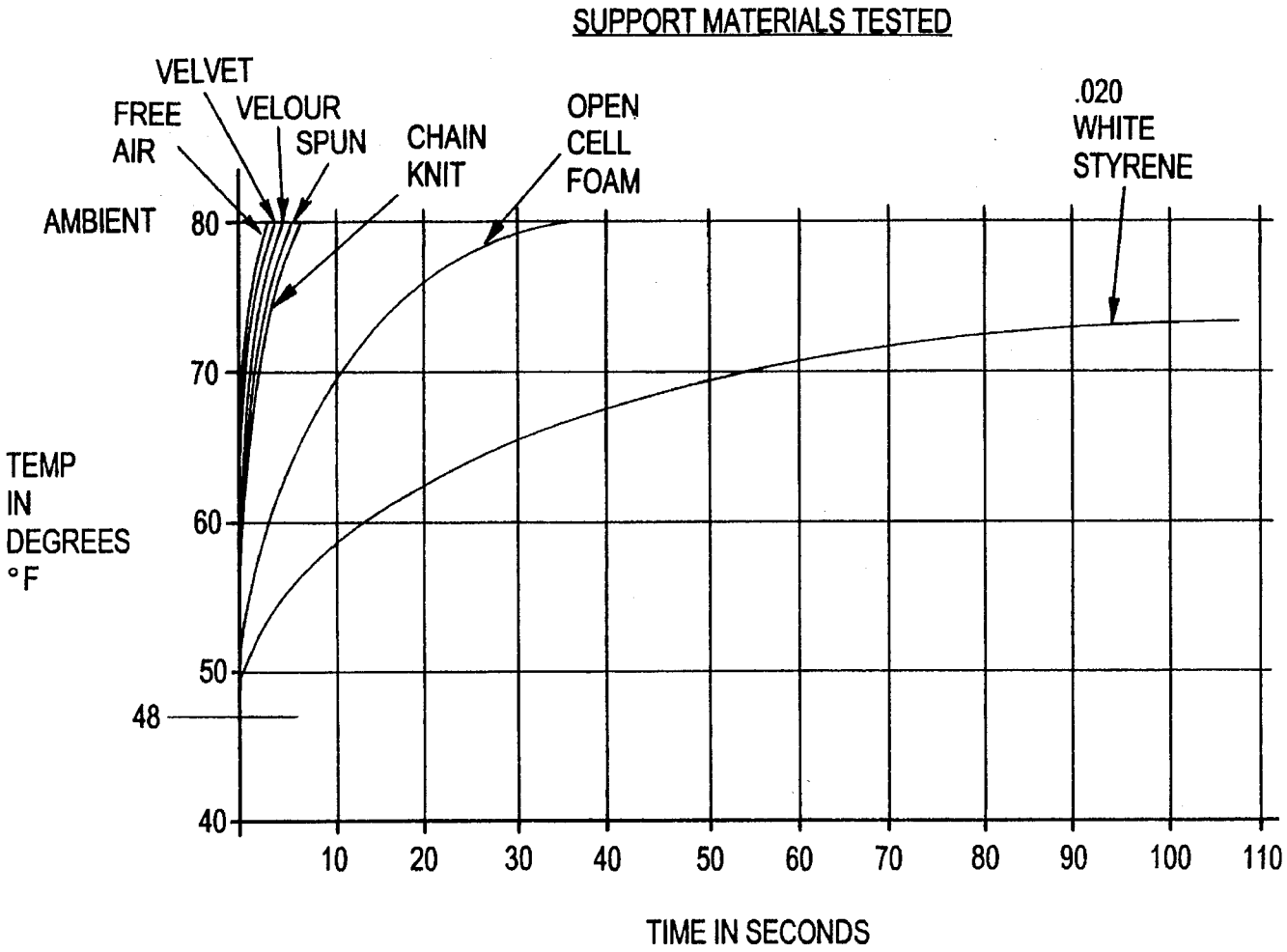
FIG. 9B is a chart illustrating the rate of temperature change of various drawing surfaces constructed with various support layers as measured by the test of FIG. 9A.

As illustrated by FIG. 9B, the surfaces constructed in accordance with the teachings of the invention return to the ambient temperature extremely quickly after a temperature source is removed. Specifically, the surfaces constructed with vertically oriented fiber support layers (i.e., velvet and velour, test specimens 2 and 3, respectively) return to the ambient temperature at a slightly faster rate than surfaces employing chain knitted and spun fiber support layers (test specimens 5 and 4, respectively).

The latent temperature test was performed using: (1) the commercially available peltier device 510 and power source 520 mentioned above in connection with the streak test; (2) the optical pyrometer 540 sold under the designation "Omega Scope OS-1000" by Omega of Stamford, Conn.; and (3) a combined processor and digital scope 550, 560 sold under the designation "3305 Digital Memory Scope" by Phillips of Holland.

Figure 10A:
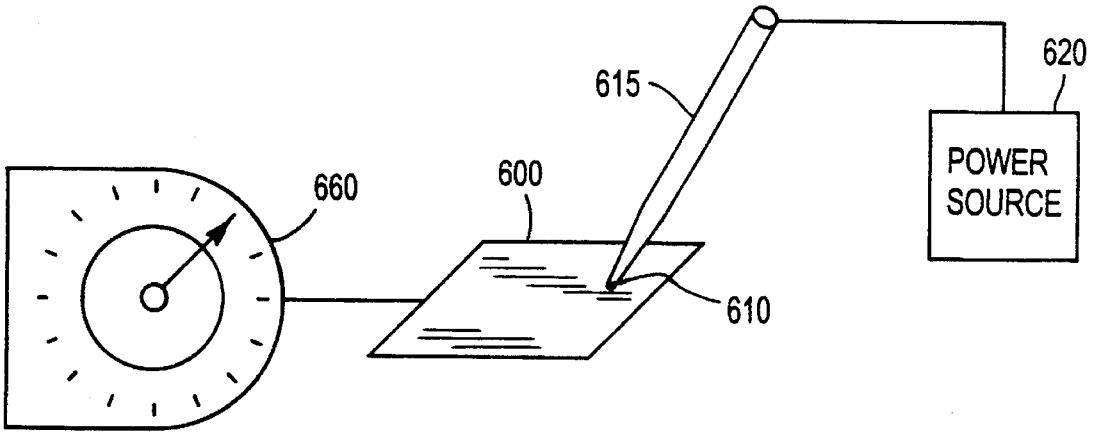
FIG. 10A is an illustration of a method for testing the amount of force to be applied to the drawing surface in order to transition the color state of the thermochromic inks of a drawing surface.
Figure 10B:
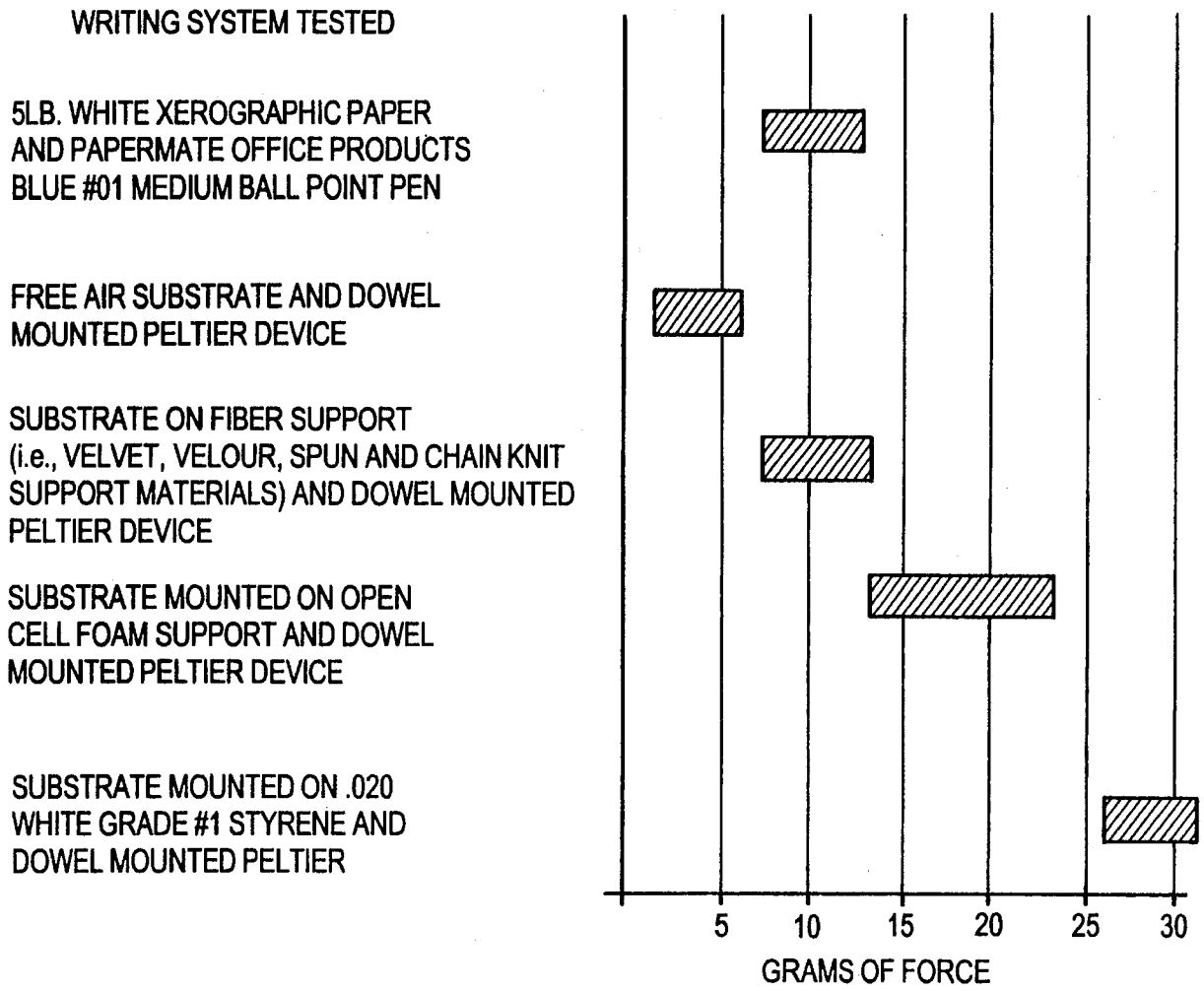
FIG. 10B is a chart illustrating the amount of force required to transition the color state of the thermochromic inks of various drawing surfaces constructed with various support layers as measured by the test of FIG. 10A; and, FIG. 11 is an illustration of a method of making the inventive thermal writing surface.

Finally, as illustrated in FIG. 10A, the amount of stylus pressure required to transition the thermochromic inks printed on the various test specimens from one color state to another was tested. This test was performed by placing a test specimen 600 upon a force meter 660, applying sufficient stylus pressure to the specimen to transition its inks at normal writing speeds, and recording the amount of force applied as measured by the force meter. It should be noted that a peltier device 610 was attached to a dowel 615 connected to a power source 620 to simulate a writing implement in performing this test. In addition, it should be noted that the test was first used to measure the normal writing force of a traditional pen and paper for later comparison with the inventive surface. Finally, the specimen was also tested for the maximum amount of stylus pressure the surface of the specimen could withstand without becoming damaged. As illustrated in FIG. 10B, the stylus pressure test revealed that the inventive drawing surface 40 employing any of the fibrous support materials will begin showing a mark at substantially the same stylus pressures as traditional paper and pen.

The stylus writing pressure test was performed using: (1) the peltier junction 610 and power source 620 discussed above in connection with the streak and latent temperature tests; and (2) a force meter 660 sold under the designation "Halda Gram Force Meter" by the Jonard Industries Corp. of Tuckahoe, N.Y.

Figure 11:
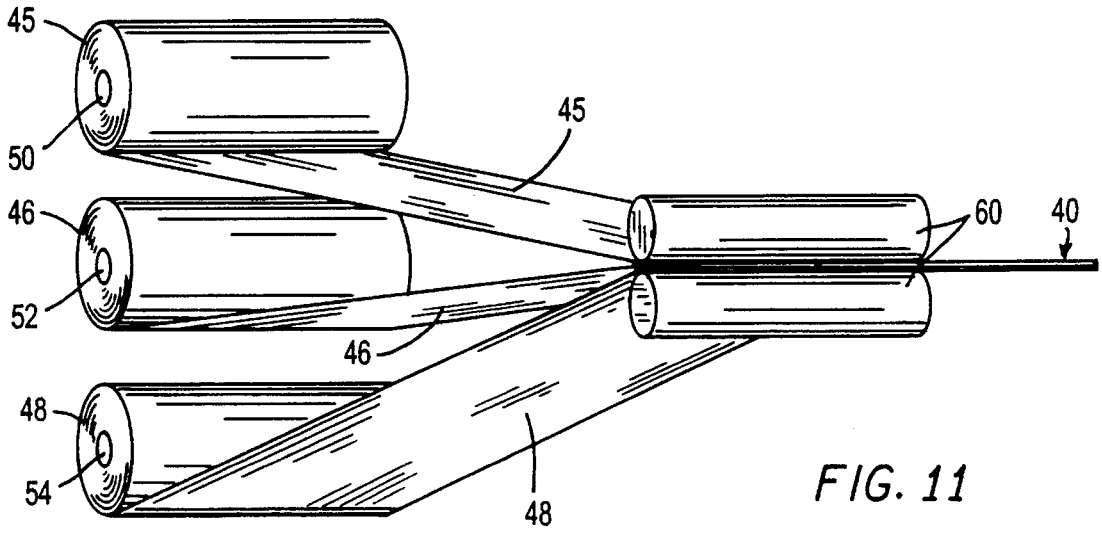

In accordance with an important aspect of the invention, the writing surface 40 can be easily and economically manufactured. As previously mentioned, the layers 42, 44, 46, 48 comprising the drawing surface 40 are commercially available products. In order to manufacture the inventive surface 40, the thermochromic inks 42 are first applied to or incorporated into the substrate 44 to form the thermochromic substrate 45. The thermochromic substrate 45 is then rolled upon a spool 50 for combination with the other layers 46, 48 as illustrated in FIG. 11.

The fibrous support material 46 and the adhesive 48 are similarly loaded upon spools 52, 54. The three spools 50, 52, 54 are then aligned and their materials uniformly unrolled and positioned adjacent to each other in layers. The layers are positioned between heat rollers 60 thereby binding the layers 42, 44, 46, 48 into one writing surface 40. It will be appreciated that the writing surface 40 can then be cut into virtually any desirable size or shape conducive to drawing and writing. The writing surface 40 is then placed into a suitable frame 20 for use.

It should be noted that any writing device or stylus capable of heating or cooling the thermal writing surface 40 sufficiently to transition the thermochromic inks from one color state to another color state can be used with the thermal writing surface 40 without departing from the invention. Thus, depending upon the thermochromic inks employed, a human hand, human finger or an ice cube could be used as a stylus. However, as previously mentioned, other writing devices could likewise be employed without departing from the scope and spirit of the invention.

In summary, the present invention provides a thermal writing surface 40 which is marked by transferring heat and which simulates the drawing characteristics of a traditional writing surface. Its thermally neutral fibrous support layer 46 insures that the temperature of the surface 40 can be easily and quickly cooled, and that the surface rapidly returns to the ambient temperature thereby permitting drawing and erasing in rapid succession.

While particular embodiments of the invention have been shown, it will be understood, of course, that the invention is not limited thereto since modifications may be made by those skilled in the art, particularly in light of the foregoing teachings. It is, therefore, contemplated by the appended claims to cover any such modifications as incorporate those features which constitute the essential features of these improvements within the true spirit and the scope of the invention.

What is claimed is:

1. A thermal writing surface for marking and erasing comprising:

a flexible substrate having a drawing side and a bottom side wherein the flexible substrate has low thermal mass for quickly assimilating temperatures applied to the drawing side;

at least one thermochromic ink applied to or incorporated within the flexible substrate and having a first color state achieved when its temperature falls below a first transition temperature and a second color state achieved when its temperature exceeds a second transition temperature, the color states being unchanged by room temperature;

a fibrous support material disposed adjacent to the bottom side of the flexible substrate and having low thermal mass and low heat conductance for quickly assimilating temperatures applied to the drawing side of the flexible substrate while transferring minimal amounts of thermal energy to or from the flexible substrate; and wherein said fibrous support material is selected from the group consisting of chain knitted material, spun fiber material, and vertically oriented fiber material.

2. A thermal writing surface as defined in claim 1 wherein the fibrous support material is thermally neutral.

3. A thermal writing surface as defined in claim 1 wherein the first transition temperature is below about 69° F. and the second transition temperature is above about 75° F.

4. A thermal writing surface as defined in claim 1 wherein the flexible substrate is printed with multiple thermochromic inks.

5. A thermal writing surface as defined in claim 1 wherein the second transition temperature is below about 98.6° F. such that a human hand placed adjacent to the drawing surface induces a transition in the thermochromic ink from the first color state to the second color state.

6. A thermal writing surface as defined in claim 1 wherein the flexible substrate is fixedly attached to the fibrous support material by heat bonding.

7. A thermal writing surface as defined in claim 1 having a writing speed of at least 10 inches per second when exposed to a temperature source of 48° F.

8. A thermal writing surface as defined in claim 1 having low thermal mass such that the substrate returns to the ambient temperature less than 30 seconds after removal of a temperature source.

9. A thermal writing surface as defined in claim 1 wherein the second color state is colorless.

10. A writing device for marking and erasing comprising:

a drawing surface including a flexible substrate having low thermal mass and incorporating at least one thermochromic ink which can be selectively transitioned between at least two color states by selectively changing the temperature of the thermochromic ink;

a frame supporting one side of the drawing surface; and a fibrous support material interposed between the flexible substrate and the frame for isolating the drawing surface from heat transfers to or from the frame, the support material having low thermal mass and low heat conductance such that areas of the support material can be rapidly heated or cooled without transferring thermal energy to or from other areas of the support material; and wherein said fibrous support material is selected from the group consisting of chain knitted material, spun fiber material, and vertically oriented fiber material.

11. A thermal writing surface as defined in claim 10 wherein the fibrous support material is thermally neutral.

12. A writing device as defined in claim 10 wherein the thermochromic ink has a first transition temperature which is below about 69° F. and a second transition temperature which is above about 75° F., the thermochromic ink attaining a first color state when its temperature falls below the first transition temperature and a second color state when its temperature passes beyond the second transition temperature and maintaining its color state upon returning to a temperature within a range between the first and second transition temperatures.

13. A writing device as defined in claim 10 wherein the flexible substrate is printed with multiple thermochromic inks.

14. A writing device as defined in claim 10 wherein the flexible substrate is fixedly attached to the fibrous support material.

* * * * *